US005902660A

United States Patent [19]

Huang

[11] Patent Number: 5,902,660

[45] Date of Patent: May 11, 1999

[54] DOUBLE BUFFERED AIR CUSHION ASSEMBLY

[76] Inventor: Ing Chung Huang, No. 218 Cheng Kong Three Road, Nantou City, Taiwan

[21] Appl. No.: 08/876,493

[22] Filed: Jun. 16, 1997

[30] Foreign Application Priority Data

Jun. 15, 1996 [TW] Taiwan ..... 85107195

[51] Int. Cl.[6] ..... B32B 3/02

[52] U.S. Cl. ..... 428/72; 428/76; 428/137; 428/178; 428/212; 36/29

[58] Field of Search ..... 428/76, 72, 166, 428/178, 188, 137, 192, 212; 36/28, 29; 206/521, 814; 229/87.02; 2/267

[56] References Cited

U.S. PATENT DOCUMENTS

| | | | |
|---|---|---|---|
| 2,028,060 | 1/1936 | Gilbert | 428/178 |
| 3,640,831 | 2/1972 | Gardner et al. | 428/178 |
| 4,262,046 | 4/1981 | Eitel | 428/178 |
| 4,386,128 | 5/1983 | Yoshikana | 428/178 |
| 4,960,625 | 10/1990 | Rosendahl | 428/178 |

*Primary Examiner*—Donald Loney
*Attorney, Agent, or Firm*—Bacon & Thomas, PLLC

[57] ABSTRACT

Enhanced fit and comfort are imparted to a shoe vamp by a double buffered air cushion assembly having an inner air cushion and an outer air cushion wherein the inflation pressure of the inner air cushion is greater than that of the outer air cushion for providing different buffering and shock-absorbing functions.

7 Claims, 7 Drawing Sheets

DOUBLE BUFFERED AIR CUSHION ASSEMBLY

BACKGROUND OF THE INVENTION

Common conventional shoe vamps have an inner layer of elastic foam rubber or sponge added under an outer layer of leather to produce a comfortable and shock-absorbing function during wear. The inner layer of foam rubber has limits in its elasticity and the thickness of the layer so that the buffer and shock-absorbing capacity of conventional shoe vamps is not ideal for practical use.

An inflatable air cushion for a shoe vamp is also known, but this device has only a two dimensional structure and does not provide an ideal shock-absorbing function.

SUMMARY OF THE INVENTION

In view of the disadvantages of the conventional shoe vamp air cushions, this invention now provides a double buffered air cushion assembly adaptable to a shoe vamp. The main feature of the invention resides in an outer air cushion having an inner air cushion disposed in the outer air cushion, with the cushions respectively having different inner pressures for forming a soft outer layer to provide a comfortable feeling and a close fit on a foot during wear.

BRIEF DESCRIPTION OF THE DRAWINGS

This invention will be better understood by referring to the accompanying drawings, wherein.

DETAILED DESCRIPTION OF THE PREFERRED EMBODIMENT

Figure 2:
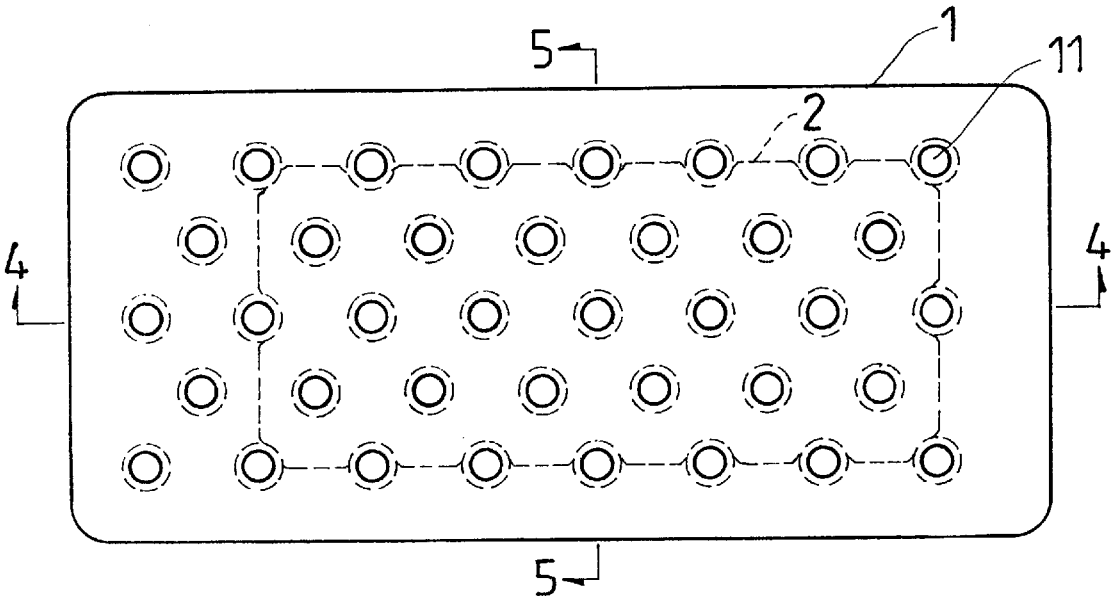
FIG. 2 is a top plan view of the cushion in FIG. 1.
Figure 1:
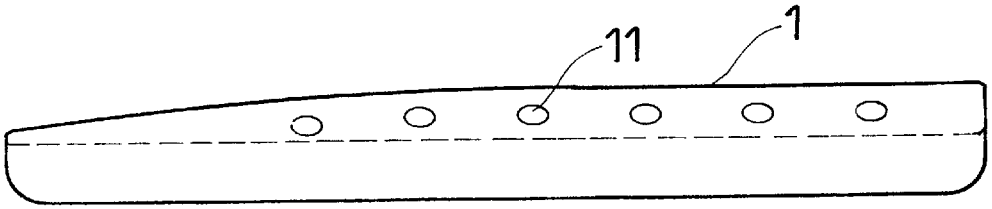
FIG. 1 is a side elevational view of a first embodiment of an air cushion according to the present invention, and adapted to a shoe vamp.
Figure 3:
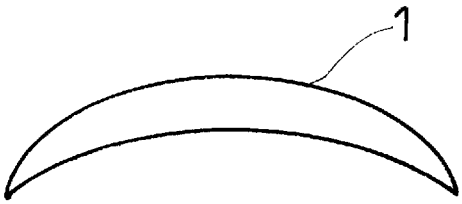
FIG. 3 is a right side elevational view of the cushion in FIG. 1.
Figure 4:
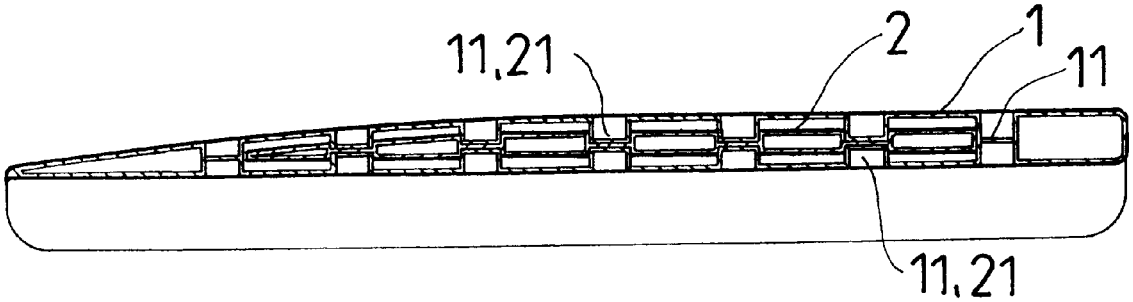
FIG. 4 is a cross-sectional view along the line 4—4 in FIG. 2.
Figure 5:
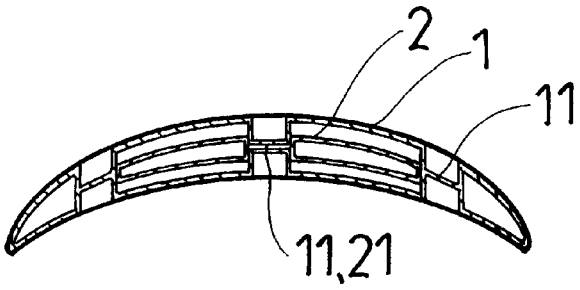
FIG. 5 is a cross-sectional view along the line 5—5 in FIG. 2.
Figure 7:
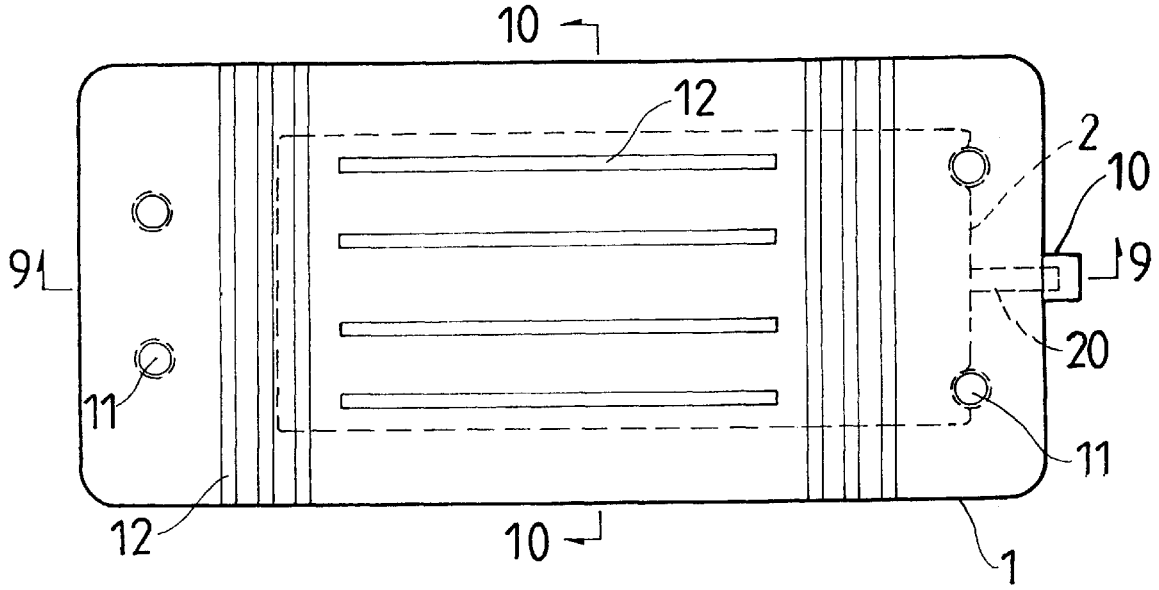
FIG. 7 is a top plan view of the cushion in FIG. 6.
Figure 6:
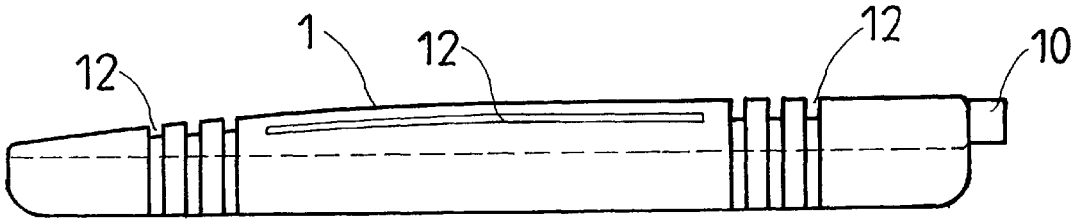
FIG. 6 is a side elevational view of a second preferred embodiment of an air cushion according to the present invention, and adapted to a shoe vamp.
Figure 8:
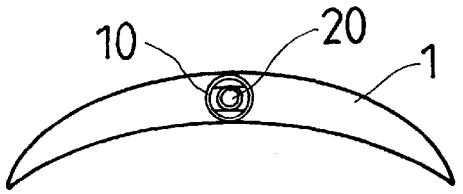
FIG. 8 is a right side view of the cushion in FIG. 6.
Figure 9:
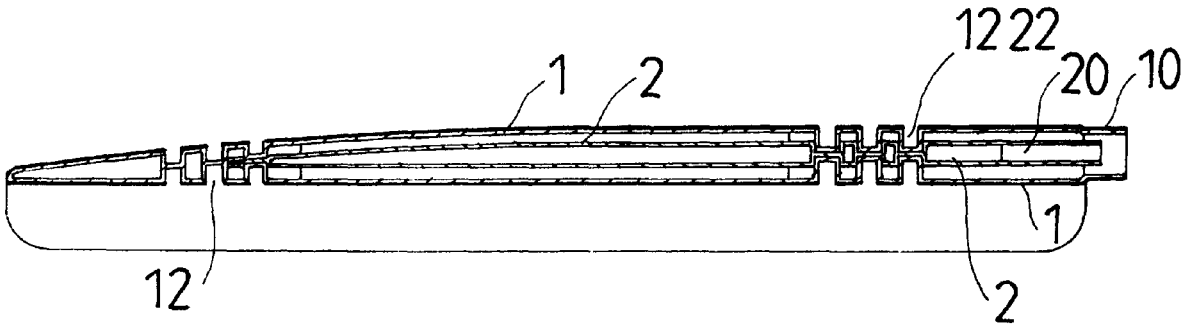
FIG. 9 is a cross-sectional view along the line 9—9 in FIG. 7.
Figure 10:
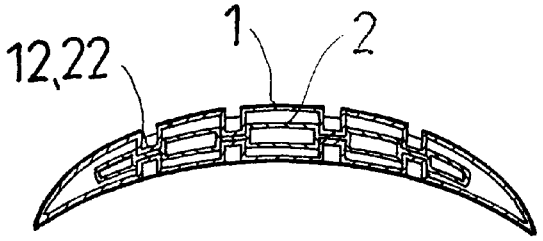
FIG. 10 is a cross-sectional view along the line 10—10 in FIG. 7.

A double buffered air cushion assembly in the present invention may be adapted to a shoe vamp, and its functions should include close fitting on a foot, buffering, and shock-absorbing. These functions are not the same as those required for a shoe heel. Its thickness must be rather thin, and its upper surface has to be of a curvature that is very similar to the curvature of a foot. In addition, the area surrounded by a peripheral hollow edge is smaller than the surface area of the air cushion assembly, thus permitting at least one surface to have a swollen three-dimensional arch shape.

FIGS. 1–5 show a first embodiment of the air cushion assembly, which includes an outer air cushion 1, and at least one inner air cushion 2 disposed in the outer air cushion 1. The outer air cushion 1 has a plurality of recessed holes 11 or recessed grooves 12 formed in an upper surface and/or a lower surface thereof, but the recessed holes 11 or the recessed grooves 12 may be omitted (as shown in FIGS. 12–16 for the third embodiment). Further, the outer air cushion 1 has at least one open side for the inner air cushion 2 to be inserted and sealed therein after the inner air cushion 2 is disposed within the outer air cushion.

The inner air cushion 2 disposed in the outer air cushion 1 has an inner pressure that is higher than the air pressure in the outer air cushion 1, and a plurality of recessed holes 21 or recessed grooves 22 formed in one or more surfaces. The depth of the recessed holes 21 and the recessed grooves 22 is less than that of holes 11 and grooves 12 of the outer air cushion 1. The width of the recessed holes 21 or the recessed grooves 22 is at least the same as the outer diameter or width of the holes 11 or the grooves 12 of the outer air cushion 1.

Further, the inner air cushion 2 has a layer of glue or adhesive attached on an outer surface thereof to adhere a contacting portion of an inner surface of the outer air cushion 1 when the inner air cushion 2 is disposed in the outer air cushion 1. The open side of the outer air cushion 1 is thereafter sealed with heat. The completed double air cushion has a single thickness with two different inner pressures.

FIGS. 6–9 show a second preferred embodiment of a double buffered air cushion of the present invention. In this embodiment, an outer air cushion 1 and an inner air cushion 2 are combined together, with recessed holes 11 or recessed grooves 12 of the outer air cushion 1 fitting within corresponding recessed holes 21 or recessed grooves 22 of the inner air cushion 2, and with holes 11 and 21 or grooves 12 and 22 of both cushions 1 and 2 firmly engaging each other after the inner air cushion 2 is inflated with a higher pressure than that of the outer air cushion 1.

The inner pressure of the outer air cushion 1 is established by a hollow passageway 10 attached on cushion 1. Then the outer air cushion 1 is inflated through the passageway 10 after its peripheral edge is sealed. The inner air cushion 2 also has a hollow passageway 20 for filling a gas in its interior to a preset pressure. In practice, the inner air cushion 2 is first inflated and then inserted in the outer air cushion 1, after which the outer air cushion 1 is thereafter inflated and sealed.

Figure 11:
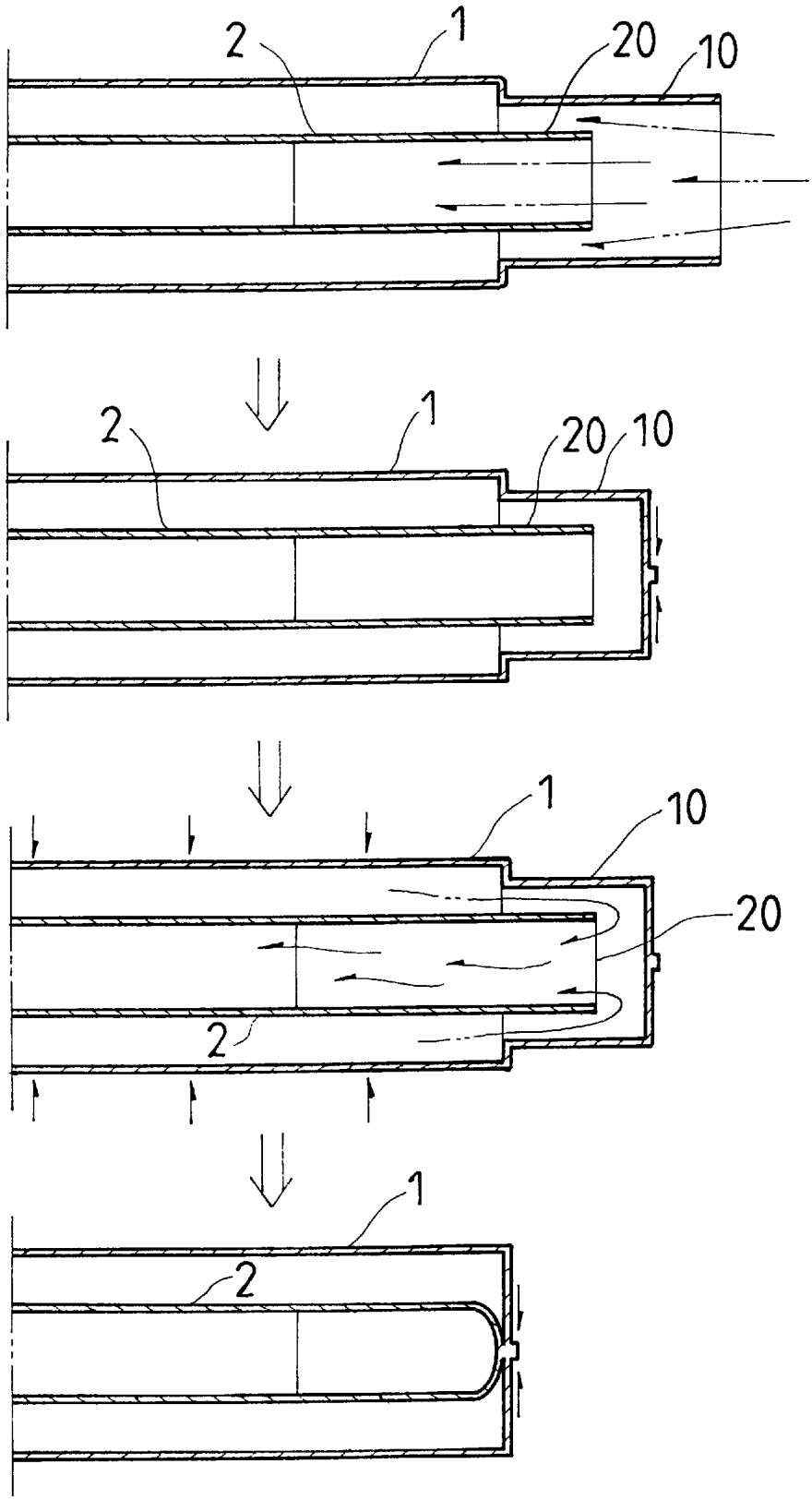
FIG. 11 is a cross-sectional view of the inflating steps for the air cushion of the present invention.
Figure 13:
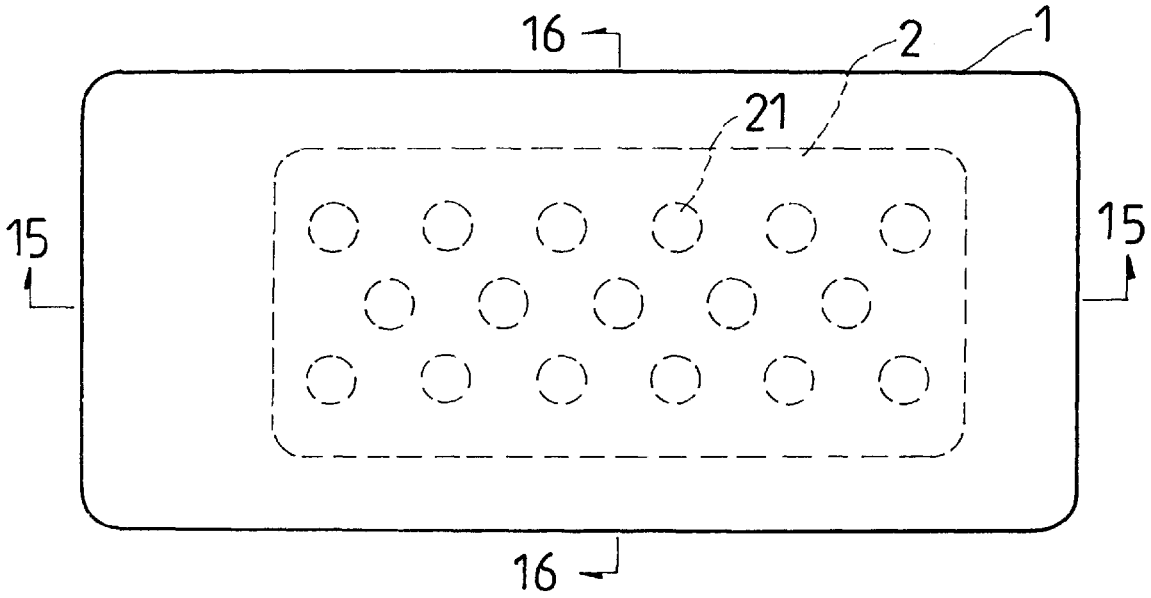
FIG. 13 is a top plan view of the cushion of FIG. 12.
Figure 12:
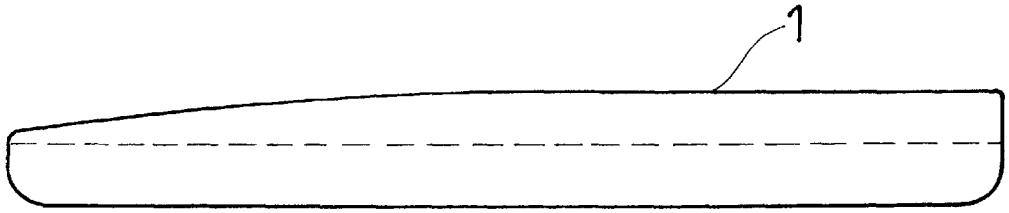
FIG. 12 is a side elevational view of a third preferred embodiment of an air cushion according to the present invention.
Figure 14:
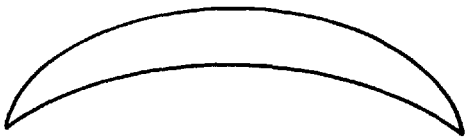
FIG. 14 is a right side elevational view of the cushion of FIG. 12.
Figure 15:
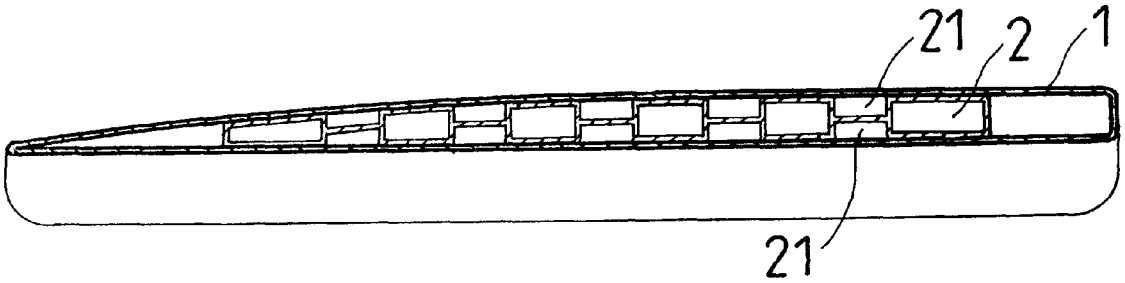
FIG. 15 is a cross-sectional view along line 15—15 in FIG. 13.
Figure 16:
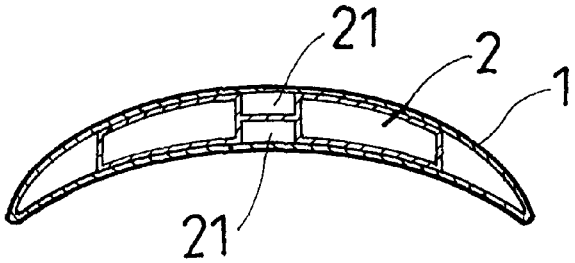
FIG. 16 is a cross-sectional view along line 16—16 in FIG. 13.

Another method of providing different inflation pressures in the outer and inner air cushions 1 and 2 is shown in FIG. 11. The respective hollow passageways 10 and 20 of the outer air cushion 1 and the inner air cushion 2 are made coaxial. At first, the same inflation pressure is provided in both the outer and the inner air cushions 1 and 2, and then the passageway 10 of the outer air cushion 1 is sealed. In this condition, the inner pressures of both the outer and the inner air cushions 1 and 2 are the same because the passageway 20 is still open to permit the inner air cushion 2 to communicate with the outer air cushion 1. Next, the outer air cushion 1 is compressed to force gas contained therein to flow into the noncompressed inner air cushion 2 through the passageway 20, thus resulting in a higher pressure in the inner air cushion 2 than in the outer air cushion 1. Then the passageway 20 is sealed with the passageway 10 to complete the cushion assembly.

The completed double buffered air cushion assembly has a soft outer air cushion 1 because of its lower inner pressure than that of the inner air cushion 2, the latter being harder than the outer air cushion 1 due to its higher inner pressure. For example, if at first the outer air cushion 1 is sealed with an inner pressure of 20 lbs., the inner pressure of the inner air cushion 2 is also of the same pressure 20 lbs., since both the two air cushions 1 and 2 communicate with each other. Then if the outer air cushion 1 is compressed to force its inner surface to contact the outer surface of the inner air cushion 2, 10 lbs. of pressure of the outer air cushion 1 may be transferred into the inner air cushion 2. Thus, the pressure of the outer air cushion 1 is reduced to 10 lbs., and the pressure of the inner air cushion 2 is increased to 30 lbs. Thereafter, the passageway 20 of the inner cushion 2 is sealed to maintain the different pressures for both cushions 1 and 2.

However, when the double buffered air cushion assembly is compressed, the inner air cushion 2 only receives 20 lbs. pressure because the outer air cushion 1 only has 10 lbs. pressure (the original 30 lbs. pressure of the inner air cushion 2 less 10 lbs.). Therefore, the whole structural load is not increased. As to buffering and shock-absorbing effects, the outer layer of the double air cushion assembly is soft and comfortable and the inner layer is a little harder than the outer layer and has a different buffering effect.

Thus, the double buffered air cushion assembly has a novel structure of different inner pressures, but having a single height, a feature not found in conventional air cushions. In addition, the interior of both the inner and the outer air cushions 1 and 2 may be filled with a gaseous fluid, such as air, a low-percolating large particle gas, such as SF6, C2F6, etc., a liquid fluid or a semi-fluid substance.

While the preferred embodiments of the invention have been described above, it will be recognized and understood that various modifications may be made thereto, and the appended claims are intended to cover all such modifications which may fall within the spirit and scope of the invention.

What is claimed is:

1. An air cushion assembly comprising:

a) an inflatable outer air cushion;

b) an inflatable inner air cushion disposed within the outer air cushion;

c) the outer air cushion being inflated to a first pressure and the inner air cushion being inflated to a second pressure, the first pressure being lower than the second pressure to define a double buffered cushion assembly wherein the outer air cushion is softer than the inner air cushion for providing different buffering and shock-absorbing functions; and d) the outer air cushion including an inner surface portion, the inner air cushion including an outer surface portion, and the inner and outer surface portions being secured together.

2. The air cushion assembly of claim 1 wherein the outer air cushion includes an open side for inserting and disposing the inner air cushion within the outer air cushion, and the open side being sealable after the inner air cushion is disposed within the outer air cushion.

3. The air cushion assembly of claim 1 further including a sealable hollow passageway for providing communication between the inner and outer air cushions.

4. The double air cushion assembly of claim 3 wherein the hollow passageway is of a coaxial configuration.

5. The air cushion assembly of claim 1 wherein the air cushion assembly is of an arch-shaped three dimensional configuration.

6. The air cushion assembly of claim 5 wherein the air cushion assembly is in the configuration of a shoe vamp.

7. The air cushion assembly of claim 1 wherein the outer air cushion includes a first wall having a plurality of first recessed portions formed therein, the inner air cushion includes a second wall having a plurality of second recessed portions formed therein, and the first and second recessed portions being disposed in engagement with each other.

* * * * *